US006462476B1

(12) United States Patent
Hirschmann et al.

(10) Patent No.: US 6,462,476 B1
(45) Date of Patent: Oct. 8, 2002

(54) LIGHTING SYSTEM WITH A HIGH-PRESSURE DISCHARGE LAMP

(75) Inventors: Guenther Hirschmann, Munich (DE); Bontcho Gotchev, Munich (DE); Arnulf Rupp, Munich (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/338,469

(22) Filed: Jun. 22, 1999

(30) Foreign Application Priority Data

Jul. 13, 1998 (DE) ..... 198 31 042

(51) Int. Cl.[7] ..... H01J 13/46

(52) U.S. Cl. ..... 315/58; 315/82; 313/318.09; 362/265

(58) Field of Search ..... 315/291, 77, 307, 315/82, 55, 56, 57, 58, 62, 32, 33, 100; 362/226, 265; 313/49, 50, 51, 312, 313, 324, 317–318.12; 439/36

(56) References Cited

U.S. PATENT DOCUMENTS 3,551,736 A 12/1970 Doehner ..... 315/100
5,216,318 A * 6/1993 Van Dulmen et al. .. 313/318.03
5,600,208 A * 2/1997 Katou et al. ..... 315/289
5,808,402 A * 9/1998 Seiler et al. ..... 313/25
5,828,174 A * 10/1998 Seiler et al. ..... 315/62
6,066,921 A * 5/2000 Nakamura et al. ..... 315/291
6,084,354 A * 7/2000 Kohmura et al. ..... 315/57

FOREIGN PATENT DOCUMENTS

DE 19610385 3/1996
EP 0786791 1/1997

* cited by examiner

*Primary Examiner*—Don Wong
*Assistant Examiner*—Ephrem Alemu
(74) *Attorney, Agent, or Firm*—William H. McNeill

(57) ABSTRACT

The invention relates to a lighting system with a high-pressure discharge lamp and a control unit (W, FS, C1, W) for the high-pressure discharge lamp (1), where the lamp base (10) has at least two housing parts (10*a*, 10*b*) which are connected to one another by a releasable closure (22). The first housing part (10*a*) has fastening means (24) for the at least one lamp vessel (11). The high-voltage part (TR) of the ignition device (TR, FS, C1) is accommodated in the first housing part (10*a*), whilst the second housing part (10*b*) is provided with the electrical connections (20) for the high-pressure discharge lamp (1) and preferably contains the remaining components (FS, C1) of the ignition device and the voltage converter (W) of the control unit.

17 Claims, 2 Drawing Sheets

LIGHTING SYSTEM WITH A HIGH-PRESSURE DISCHARGE LAMP

Figure 1:
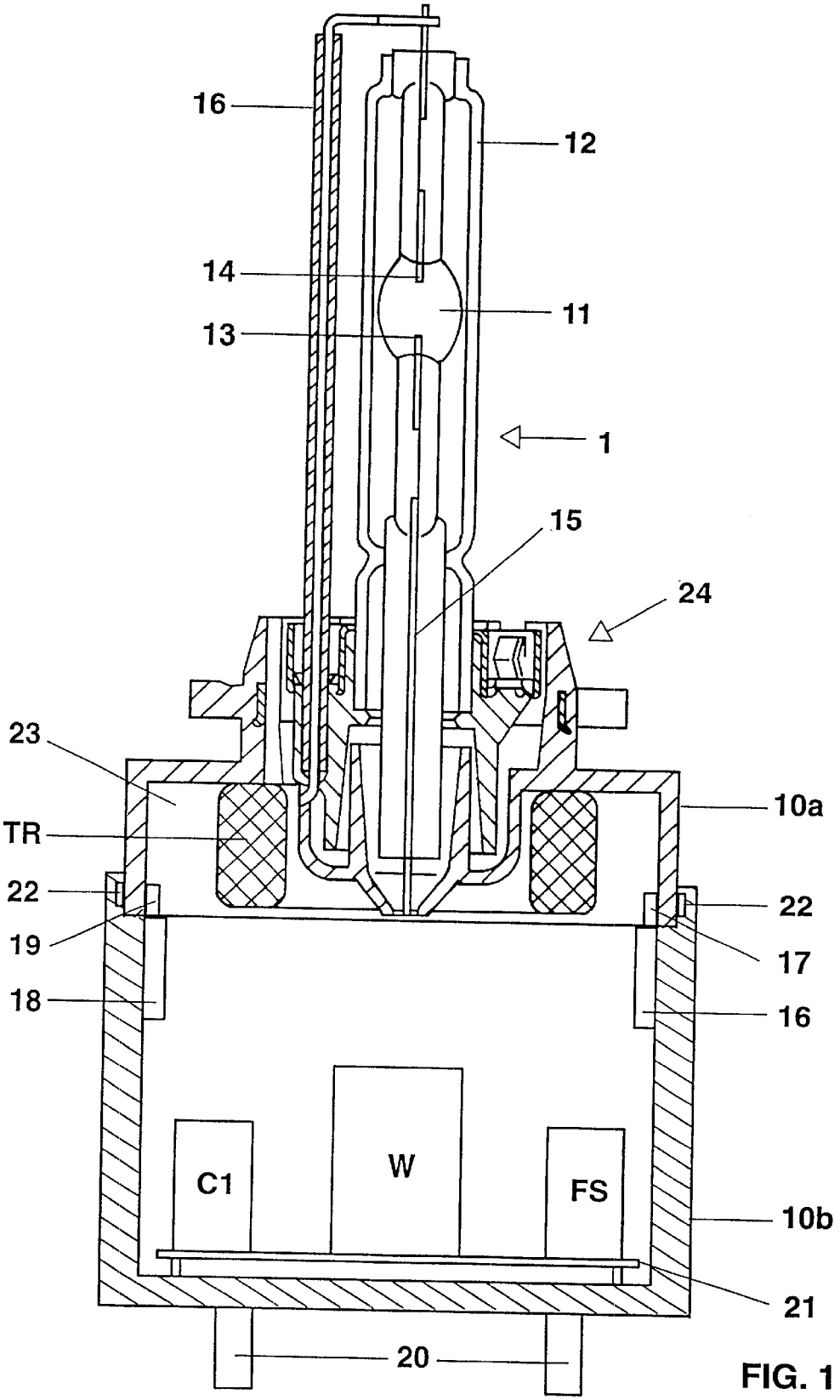

The invention relates to a lighting system according to the preamble to patent claim 1.

I. PRIOR ART

Such a lighting system is disclosed, for example, in German Laid-Open Specification DE 196 10 385 A1. This document describes a high-pressure discharge lamp for motor vehicle headlamps, which has a lamp vessel of glass, two electrodes and a lamp base provided with electrical connections. A control unit for the high-pressure discharge lamp is integrated in the lamp base. The control unit usually has a considerably longer service life than the high-pressure discharge lamp. However, since the control unit is inseparably integrated in the lamp base, it cannot continue to be used if the lamp is faulty, but has to be replaced together with the faulty lamp.

II. DESCRIPTION OF THE INVENTION

The object of the invention is to avoid the disadvantage of the lighting system according to the prior art.

The invention achieves this object as a result of the distinguishing features of patent claim 1. Particularly advantageous refinements of the invention are described in the subclaims.

The lighting system according to the invention has a high-pressure discharge lamp and a control unit for the high-pressure discharge lamp, the high-pressure discharge lamp having at least one lamp vessel, electrodes and an illuminant for producing a gas discharge, as well as a base provided with electrical connections. The base additionally has fastening means for the at least one lamp vessel. The control unit has an ignition device which is accommodated in the base and has a high-voltage part. According to the invention, the base has at least two housing parts, which are connected to one another by a releasable closure, the first housing part having the fastening means for the at least one lamp vessel, and the high-voltage part being accommodated in the first housing part, whereas the second housing part is provided with the electrical connections for the high-pressure discharge lamp.

The aforementioned measures according to the invention allow the second housing part, with the components arranged in it, to continue to be used if the high-pressure discharge lamp is faulty, in that the closure between the first and the second housing part is released. The first housing part is replaced together with the faulty high-pressure discharge lamp fastened to it. For technical safety reasons, the invention provides for the first housing part to accommodate the high-voltage part, advantageously comprising a transformer, of the ignition device, said high-voltage part having to be replaced together with the faulty high-pressure discharge lamp. The high-voltage part of the ignition device is advantageously embedded in a potting compound which improves its electrical insulation. In addition, the high-voltage connection, connected to a lamp electrode, of the high-voltage part is advantageously also embedded in the potting compound for the same purpose.

The further components of the ignition device, such as the ignition capacitor and the spark gap, are advantageously arranged in the second housing part. As a result, these components of the ignition device need not be replaced if the high-pressure discharge lamp is faulty. The further components of the ignition device are advantageously arranged on a support plate, which can easily be inserted into the second housing part. The at least two housing parts are advantageously connected to one another releasably by a snap-fit or screw-fit closure or by a plug connection. In addition, the first housing part advantageously has first electrical contacts and the second housing part has second electrical contacts, between which an electrically conductive connection is made when the first and the second housing part are connected to one another. The first and second electrical contacts of the housing parts advantageously form a plug connection which is produced automatically when the at least two housing parts of the base are fitted. This ensures that the lamp base is easy to assemble.

At least one housing part of the base is advantageously fitted with a cooling device which dissipates heat generated by the control unit. In addition, the first and/or the second housing part are shielded against electromagnetic radiation, which improves the electromagnetic compatibility of the lighting system according to the invention.

The control unit in the lighting system according to the invention has, in addition to the ignition device, a voltage converter which is advantageously designed as an inverter, for example as a half-bridge or full-bridge inverter, as a push-pull inverter or as a single-ended converter. This voltage converter is advantageously arranged on the same support plate as the aforementioned further components of the ignition device. This means that the whole control unit for the high-pressure discharge lamp can be accommodated in the base of the lamp. The arrangement is particularly compact and advantageous if the aforementioned voltage converter is designed as an integrated circuit.

The invention can be applied particularly advantageously to a lighting system with a high-pressure discharge lamp with a base at one end and with one electrode near to and one remote from the base. Such a lighting system is used in a motor vehicle headlamp, for example. The at least one high-voltage connection of the high-voltage part of the ignition device is in this case advantageously connected to that electrode of the high-pressure discharge lamp that is near to the base. This ensures that those parts carrying high voltage are enclosed inside the first housing part or the lamp vessel such that they are protected from accidental contact. In addition, this means that the electrical connections of the base of the high-pressure discharge lamp have only the comparatively low vehicle supply voltage of the motor vehicle applied to them. That electrode of the high-pressure discharge lamp that is remote from the base, and the connections of the primary of the transformer in the ignition device, are advantageously electrically conductively connected to the first electrical contacts of the first housing part. These measures ensure that the high-pressure discharge lamp and the primary of the ignition transformer automatically make electrical contact, during assembly of the base, with the control unit components accommodated in the second housing part.

III. DESCRIPTION OF THE PREFERRED EXEMPLARY EMBODIMENT

Figure 2:
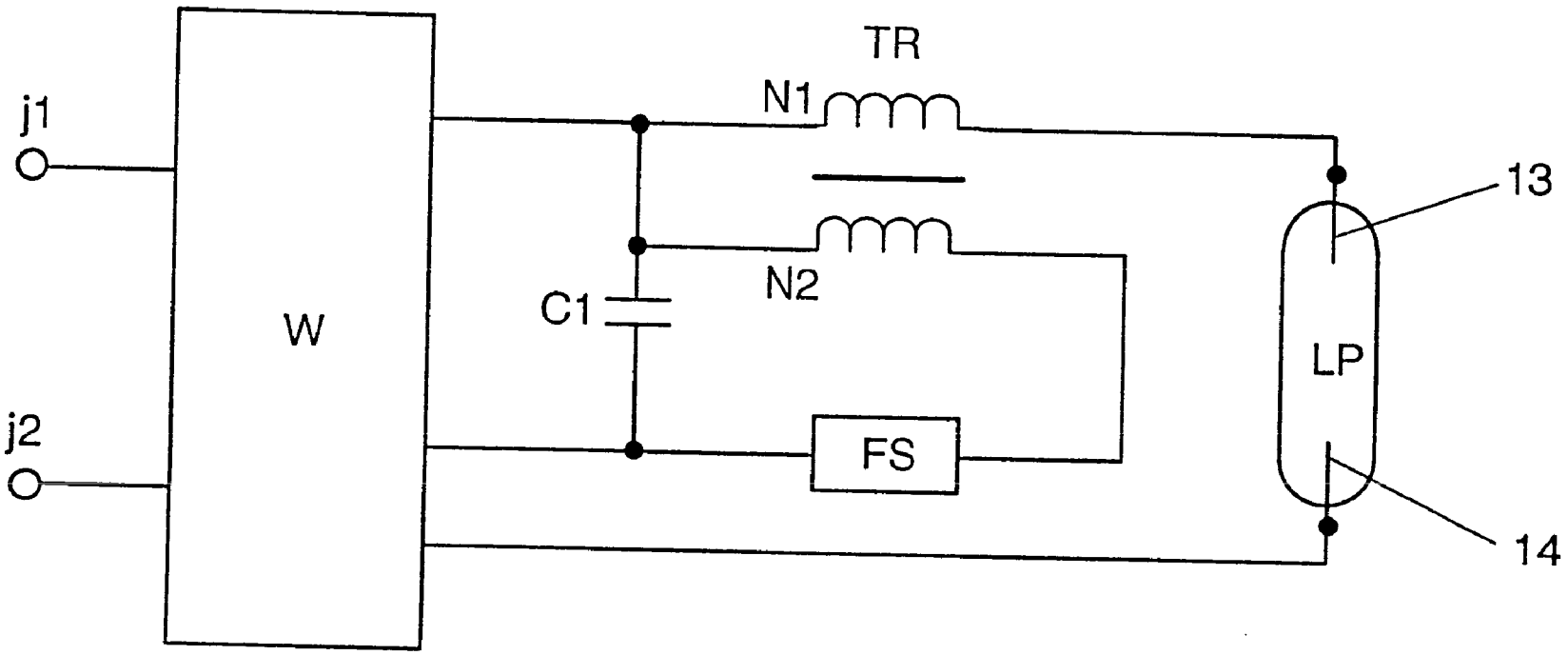

The invention is explained in more detail below with the aid of a preferred exemplary embodiment. In the figures:

FIG. 1 shows a schematic illustration of a cross section through the preferred exemplary embodiment of the lighting system according to the invention, and FIG. 2 shows a simplified, schematic circuit diagram of the control unit in the preferred exemplary embodiment of the lighting system according to the invention.

The preferred exemplary embodiment of the invention is a lighting system comprising a halogen metal-vapor high-pressure discharge lamp 1 with a base at one end and a control unit TR, C1, FS, W arranged in the base 10 of this lamp 1. This lighting system is suitable, for example, for use in a motor vehicle headlamp.

The lamp 1 has a discharge vessel 11 which is made of quartz glass, is surrounded by an outer bulb 12 and contains an electrode 13 near to the base and an electrode 14 remote from the base. The two lamp vessels 11, 12 are anchored in the base 10 of the high-pressure discharge lamp 1. The base 10 has a first housing part 10*a* and a second housing part 10*b*, which are both made of plastic. The first housing part 10*a* forms the top part of the base and the second housing part 10*b* forms the bottom part of the base of the high-pressure discharge lamp 1. The two housing parts 10*a*, 10*b* are connected to one another by a releasable snap-fit closure 22. The second housing part 10*b* is fitted with the electrical connections 20 for the lamp base 10, which are designed as plug connectors 20. The top part of the base 10*a* has first electrical contacts 17, 19, which, when the base 10 is assembled, that is to say when the two housing parts 10*a*, 10*b* are joined together, produce a plug connection and hence an electrical connection with the second electrical contacts 16, 18, mounted on the bottom part of the base 10*b*.

The control unit of the lighting system according to the preferred exemplary embodiment comprises an ignition device and a voltage converter, which converts the vehicle supply voltage into the operating voltage required for lamp operation. The ignition device has a high-voltage part, comprising a toroidal-core transformer TR, and a spark gap FS as well as an ignition capacitor C1. The transformer TR has a primary N2 and a secondary N1. The aforementioned components TR, FS, C1 are connected, in a known manner, to a pulse ignition device which produces the ignition voltage necessary for igniting a gas discharge in the high-pressure discharge lamp 1. The transformer TR is arranged in the interior of the first housing part 10*a*, designed as the top part of the base, and is embedded in an electrically insulating potting compound 23. The further components of the ignition device, that is to say the spark gap FS and the ignition capacitor C1, are mounted on a support board 21 which is arranged in the second housing part 10*b*, which forms the bottom part of the base. The voltage converter W of the control unit is also mounted on the same support board 21. The voltage converter W is an inverter W, preferably a full-bridge inverter, which converts the vehicle supply voltage of the vehicle at its voltage input j1, j2 into a square-wave voltage whose amplitude assumes voltages between about 0 V and −80 V. FIG. 2 shows a simplified, schematic circuit diagram of the control unit. The lamp LP is connected in the bridge path of the inverter W. That electrode 13 of the high-pressure discharge lamp 1 that is near to the base is connected to the secondary N1 of the transformer TR via the power supply line 15 and has high-voltage pulses applied to it during the ignition process. The inverter W, arranged on the support board 21, is electrically conductively connected to the second electrical contacts 16, 18 in the bottom part of the base 10*b*. The power return line 16 of the high-pressure discharge lamp 1 makes an electrical connection between the electrode 14 remote from the base and the first electrical contact 19 in the top part of the base 10*a*. The lamp vessels 11, 12 are fixed to the top part of the base 10*a* by means of the fastening device 24 in a known manner. The fastening device 24 is described, for example, in German Laid-Open Specification DE 196 02 625.3.

The invention is not restricted to the exemplary embodiment described in detail above. For example, the housing parts 10*a*, 10*b* can also be made of a metal or a metalized plastic instead of plastic, in order to improve the electromagnetic compatibility of the lighting system. In addition, the base 10 or one of the housing parts 10*a*, 10*b* or both housing parts can be provided with a cooling device, for example with cooling ribs, for the control unit. Furthermore, it is also possible to provide the base 10 or the housing parts 10*a*, 10*b* with a shield against electromagnetic radiation, in order to improve electromagnetic compatibility. Instead of a full-bridge inverter, it is also possible to use a half-bridge inverter or another voltage converter, for example a single-ended converter. Moreover, it is possible to accommodate not only the high-voltage part TR but also the whole ignition device TR, FS, C1 in the first housing part 10*a*. In this case, the whole ignition device would also have to be replaced if the lamp 1 were faulty.

What is claimed is:

1. A lighting system with a high-pressure discharge lamp and a control unit (W, FS, C1, W) for the high-pressure discharge lamp (1), where the high-pressure discharge lamp (1) has at least one lamp vessel (11) and electrodes (13, 14) and an illuminant for producing a gas discharge, the high-pressure discharge lamp (1) has a base (10) provided with electrical connections (20) for the high-pressure discharge lamp (1) and having fastening means (24) for the at least one lamp vessel (11), the control unit (W, FS, TR, C1) has an ignition device (TR, FS, C1) for igniting the gas discharge in the high-pressure discharge lamp (1), the ignition device (TR, FS, C1) is accommodated in the base (10) and has a high-voltage part (TR) for producing a high voltage, wherein the base (10) has at least two housing parts (10*a*, 10*b*) which are connected to one another by a releasable closure (22), the first housing part (10*a*) has the fastening means (24) for the at least one lamp vessel (11), the high-voltage part (TR) is accommodated in the first housing part (10*a*), and the second housing part (10*b*) is provided with the electrical connections (20) for the high-pressure discharge lamp (1).

2. The lighting system as claimed in claim 1, wherein the high-voltage part (TR) is designed as a transformer.

3. The lighting system as claimed in claim 1, wherein the ignition device has further components (FS, C1), which are arranged in the second housing part (10*b*).

4. The lighting system as claimed in claim 3, wherein the further components comprise a spark gap (FS) and an ignition capacitor (C1).

5. The lighting system as claimed in claim 1, wherein the control unit has a voltage converter (W) which is accommodated in the second housing part (10*b*).

6. The lighting system as claimed in claim 5, wherein the voltage converter (W) is designed as an integrated circuit.

7. The lighting system as claimed in claim 1, wherein the releasable closure (22) is a closure from the group comprising a snap-fit closure, screw-fit closure or plug connection.

8. The lighting system as claimed in claim 1, wherein the high-voltage part (TR) is embedded in a potting compound (23).

9. The lighting system as claimed in claim 1, wherein the first housing part (10*a*) has first electrical contacts (17, 19) and the second housing part (10*b*) has second electrical contacts (16, 18), an electrically conductive connection being produced between the first (17, 19) and second contacts (16, 18) when the releasable closure (22) is closed.

10. The lighting system as claimed in claim 9, wherein the first (17, 19) and second electrical contacts (16, 18) form a plug connection.

11. The lighting system as claimed in claim 3, wherein the further components (FS, C1) of the ignition device are arranged on a support board (21).

12. The lighting system as claimed in claims 5 and 11, wherein the voltage converter (W) is arranged on the support board (21).

13. The lighting system as claimed in claim 5, wherein the voltage converter (W) is an inverter.

14. The lighting system as claimed in claim 8, wherein the high-voltage part (TR) has at least one high-voltage connection, the at least one high-voltage connection being electrically conductively connected to one electrode (13) of the high-pressure discharge lamp (1) and being embedded in the potting compound.

15. The lighting system as claimed in claim 1, wherein the high-pressure discharge lamp (1) is a high-pressure discharge lamp with a base at one end and with one electrode near to (13) and one remote from (14) the base.

16. The lighting system as claimed in claim 1, wherein at least one housing part has a cooling device.

17. The lighting system as claimed in claim 1, wherein the first (10*a*) and/or the second housing part (10*b*) are shielded against electromagnetic radiation.

* * * * *